United States Patent [19]

Shibata

[11] 4,275,773

[45] Jun. 30, 1981

[54] WEFT CUTTING DEVICE IN SHUTTLELESS LOOM

[75] Inventor: Kazuo Shibata, Sagamihara, Japan

[73] Assignee: Nissan Motor Company, Limited, Tokohama, Japan

[21] Appl. No.: 83,548

[22] Filed: Oct. 10, 1979

[30] Foreign Application Priority Data

Oct. 12, 1978 [JP] Japan ..... 53/124658
Mar. 12, 1979 [JP] Japan ..... 54/27626

[51] Int. Cl.[3] ..... D03D 47/34

[52] U.S. Cl. ..... 139/429; 139/194; 139/302

[58] Field of Search ..... 139/194, 302, 303, 429, 139/450

[56] References Cited

U.S. PATENT DOCUMENTS 3,792,723 2/1974 Titou ..... 139/194
3,845,790 11/1974 Filter et al. ..... 139/194
4,088,159 5/1978 Komarou et al. ..... 139/194
4,134,434 1/1979 Malasek et al. ..... 139/429

FOREIGN PATENT DOCUMENTS 1410749 10/1968 Fed. Rep. of Germany ..... 139/302

*Primary Examiner*—Henry Jaudon
*Attorney, Agent, or Firm*—Silverman, Cass & Singer, Ltd.

[57] ABSTRACT

A weft cutting device in a shuttleless loom is provided with a plate-like cutting member which after completion of beating is caused to move between a pair of weft guide members and across the weft held in position by stepped portions provided for the guide members. Escapement of the weft from the stepped portion is prohibited by an escapement preventing member located near the guide members. Weft is sufficiently tensioned by a tensioning member disposed near the cutting member and engaging weft earlier than the cutting member.

9 Claims, 8 Drawing Figures

WEFT CUTTING DEVICE IN SHUTTLELESS LOOM

The present invention relates to a weft-cutting device in a shuttleless loom.

In a shuttleless loom, during weaving operation wefts after being inserted are cut away on both sides of the woven cloth. Specifically, the cuting on the insertion side is effected before the subsequent insertion, namely at a predetermined time point after the beating, while the cutting of the margine on the opposite side is effected after two to three picking operations.

Conventionally, the weft-cutting device in an airjet-type loom consists of a scissors-like cutter comprising two blades which are connected to each other by means of a pin in a press contact relationship, and driven by a cam or the like to be opened or closed synchronously with the operation of the loom, to effect the cutting.

Currently, looms are designed to have a high operational speed which is as high as 500 RPM. Accordingly, the above-mentioned scissors-like cutters have to be opened and closed 500 times per minute, i.e., seven hundred and twenty thousand times per day. This means that, after a certain operational time length, the connection between the blades may become loose. Also, due to insufficient supply of lubricating oil, the blades may be seized. Furthermore, sharp cutting cannot be expected when the cutting edge of the blades become worn and dull. In cutting glass fibers, for example, the cutting performance will be deteriorated in short a time so that the blade has to be ground in every 40 to 50 hours in order to assure a sharp cutting.

With these drawbacks of the conventional arrangement in view, it is an object of the present invention to provide an improved weft-cutting device which is superior in the cutting performance as well as in the durability even when the loom is used in weaving glass fibers.

According to the present invention, the cutting device is not provided with cutting blades, but with a thin cutting plate. Weft which is brought to a predetermined location during or after the beating is engaged by a pair of weft guide members. The cutting plate is moved between the pair of the guide members across the weft held by the guide members, and cuts the weft at the edge portion thereof.

By this arrangement, the cutting device according to the present invention provides an excellent cutting performance and a remarkable durability. This is due to the fact that the present invention excludes provision of cutting blades which, at the time of cutting glass fibers, are subjected to premature wear resulting in the deterioration in the cutting performance, as well as provision of scissors-like cutters which are in sliding engagement under a high surface pressure. Moreover, the guide members for the weft serve to sufficiently tension the weft at the cutting, and the timing for the cutting can be set in a facilitated manner.

After completion of the beating, the weft is engaged by the pair of the weft guide members at a location which is in the neighborhood of the extension line of the cloth fell. If the weft guide members are respectively provided with hook-shaped holding portion, in which the weft is engaged, the weft at first has to be brought to a position above the extension line of the cloth fell, and then back toward the reed into the recess formed by the hook. In this case, the weft is held in slightly loose condition, and not under the maximum tension. Adding to this, for yarns having a low elongation ratio, the so-called two stage gripper is used to grip the weft. In order to prevent breaking of the weft during the beating due to an increase of the weft path and hence, of the tension, gripping force is reduced so as to draw out the weft from the supply side and to further reduce the tension applied to the weft. By this, the weft is further loosened so that it may not be properly held in position with sufficient tension and may sometimes escape from the hook-shaped recess of the guide member due to mechanical vibration of the loom. With such an escapement, the weft can not be cut by the cutting means so that a subsequent picking operation on the insertion side will be impossible.

According to a further development of the present invention, in order to positively hold the weft in a predetermined location of the guide members, the cutting device is provided with an escapement preventing member extending in a juxtaposed relationship with the guide members. This escapement preventing member is arranged such that as the weft tends to escape from the guide members, the weft abuts the escapement preventing member which then prohibits the weft from escapement.

Even when such an escapement is prevented, if the weft is held in place still in a loose condition, the weft will be cut by the cutting plate only after being bent toward the reed and applied with an increased tension so that the selvage will be slightly long.

According to a still further development of the present invention, in order to sufficiently tension the weft before it is being cut, to thereby shorten the selvage as far as possible, the cutting device is provided with a tensioning member which engages the weft before the engagement of the cutting member and the weft. By this arrangement, the weft can be sufficiently tensioned and only thereafter the cutting is effected.

The present invention will now be explained more in detail with reference to preferred embodiments shown in the drawings, in which.

Throughout the figures, like parts are denoted by like numerals.

Figure 1:
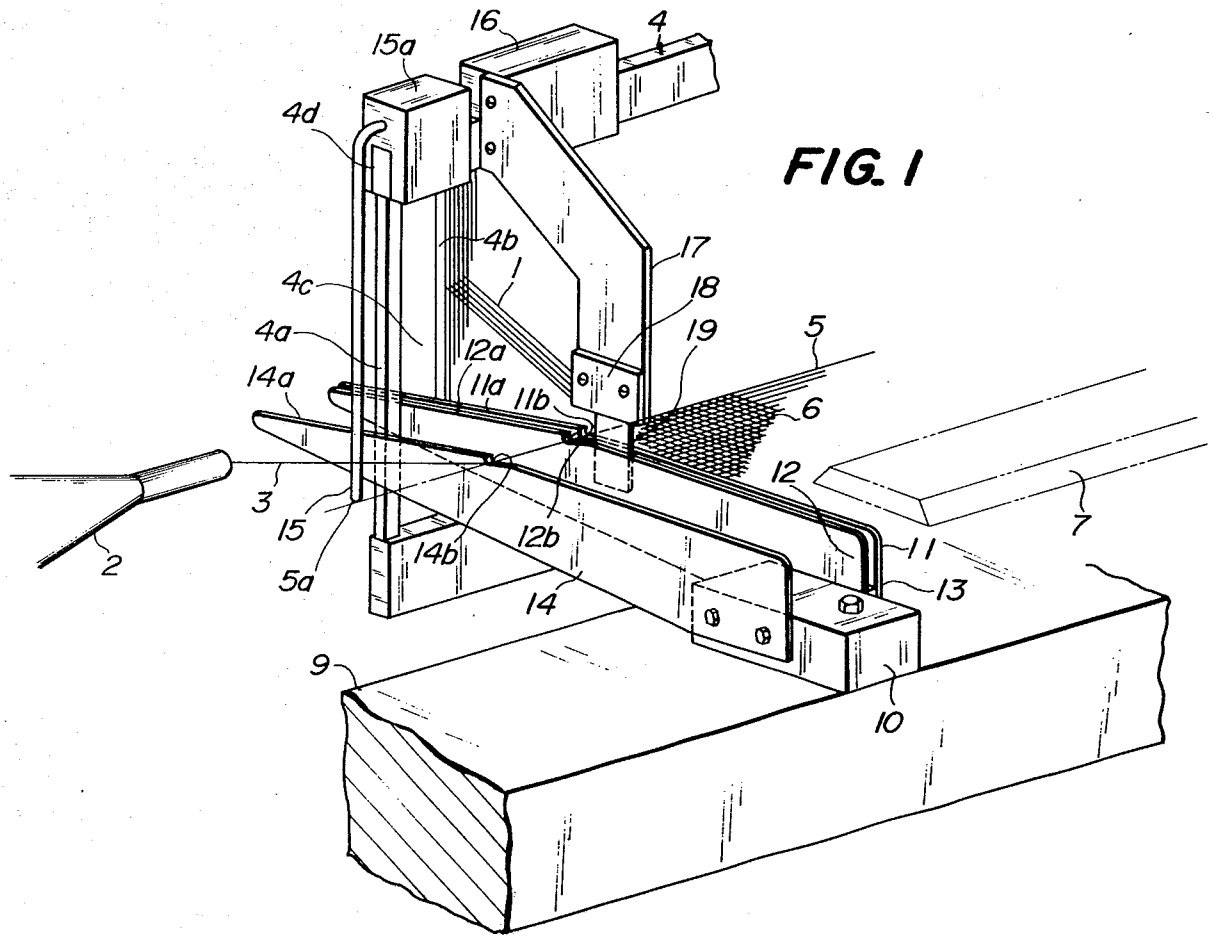
FIG. 1 is a perspective view of a cutting device according to a first embodiment of the present invention.

Referring firstly to FIG. 1, there is shown a first embodiment of the present invention, wherein reference numeral 1 denotes warps, 2 a nozzle for inserting wefts 3, 4 a reed, 5 a cloth fell, 6 a cloth, 7 a temple bar and 8 a frame having a top stay 9.

A bracket 10 having a rectangular cross-section is fixedly mounted on the top stay 9 of the frame. On the side of the bracket 10 facing to the cloth 6, there are fixedly mounted a pair of plate-like members 11, 12 for guiding the wefts, which extend parallel with the warps 1 and beyond the extension line 5*a* of the cloth fell 5. Between the fixed ends of the guide members 11, 12 is disposed a spacer member 13 so that the members 11, 12 are arranged in parallel with each other with a predetermined gap therebetween. As will be apparent from the following description, this gap is so sized to allow the movement of a plate 19 while contacting the opposing side surfaces of the guide members 11, 12, or to be slightly greater than the thickness of the plate 19.

The pair of the weft guide members 11, 12 are of identical configuration and respectively provided with inclined guide portions 11*a*, 12*a* extending between the free ends and the middle parts of the members. The guide portions 11*a*, 12*a* extend at an angle substantially identical to that of the lower warps forming a warp shed. The ends of the guide portions 11*a*, 12*a* terminating at the middle parts of the guide members are located at, or adjacent to the positions intersecting the extension line 5*a* of the cloth fell 5, and stepped to form recesses 11*b*, 12*b* which serve to engage the weft as shown in FIG. 1.

The pair of the weft guide members 11, 12 are disposed adjacent to the side frame 4*a* of the reed 4 whose blades 4*b* are not arranged at the location of the guide members 11, 12 so as to leave a space 4*c* permitting respective movement of the guide members 11, 12 at the time of beating.

On the side of the bracket 10 remote from the cloth 6, there is fixedly mounted a weft guide member 14 which is identical in shape with the pair of the guide members 11 and 12, and is provided accordingly with an inclined guide portion 14*a* and a recess 14*b* for engaging the weft. This guide member 14 is disposed slightly outside of the reed 4. A guide rod 15 is provided, with its one end 15*a* fixed to the upper frame 4*d* of the reed 4, extending parallel with, and slightly outside of the guide member 14.

A bracket 16 is fixed to the upper frame 4*d* of the reed 4, and an arm 17 is fixed to the bracket 16 extending downwardly in front of the reed 4. The arm 17 at its lower end corporates with a clamp piece 18 to clamp a cutting plate 19 therebetween. Where the cutting plate is used to cut glass fibers only, it may consist of a thin plate which is not formed with a blade. The cutting plate 19 is disposed between the pair of the weft guide members 11, 12.

Following the movement of the reed 4, the cutting plate 19 is moved between the pair of the guide members 11, 12 forwardly and rearwardly (toward right and left in the figure) between the forward extreme position in which the cutting plate 19 is positioned in front of the recesses 11*b*, 12*b* and the rearward extreme position in which the cutting plate 19 is positioned behind the recesses 11*b*, 12*b*.

Operation of the above described embodiment is as follows:

As a fluid jet is ejected from the nozzle 2 and a gripper (not shown) releases the weft 3, the weft 3 is inserted into the warp shed. During beating of the inserted wefts 3 effected by advancing the reed 4, the weft 3 between the blade 4*b* and the side frame 4*a* of the reed 4 is pressed thereby and moves along the inclined guide portions 11*a*, 12*a* of the guide members 11, 12 and finally into the recesses 11*b*, 12*b* to be engaged therein. Similarly, the weft 3 between the side frame 4*a* and the guide rod 15 is pressed thereby and moves along the inclined guide portion 14*a* of the guide member 14 and finally into the recess 14*b* to be engaged therein.

Accordingly, even when the reed 4 is retracted after completion of the beating, engagement of the weft 3 and the recesses 11*b*, 12*b*, 14*b* is maintained and the weft 3 is kept tensioned on the extension line 5*a* of the cloth fell 5.

As the reed 4 is retracted and the cutting plate 19 moving between the pair of the guide members 11, 12 reaches the recesses 11*b*, 12*b* at a predetermined time point, the cutting plate 19 at its edge facing to the reed 4 engages the weft 3 held by the recesses 11*b*, 12*b* and cuts the same.

According to this embodiment, since the cutting plate 19 is fixedly connected to the reed 4, drive mechanism for the cutting plate can be dispensed with.

In this embodiment, the recesses 11*b*, 12*b* for holding the weft may be replaced by stepped portion forming an upstanding toward the reed 4. In order to shorten the length of the selvage as far as possible, the pair of the weft guide members 11, 12 should be disposed in the vicinity of the cloth 6. Since a sufficient tensioning of the weft 3 may not be maintained by this measure only, there is provided a further weft guide member 14 in juxtaposed relationship with the guide members 11, 12, and a guide rod 15 for guiding the weft 3 into the recess 14*b* of the guide member 14. If, however, the weft can sufficiently be tensioned without the guide member 14 and the guide rod 15, they may be dispensed with.

Figure 2:
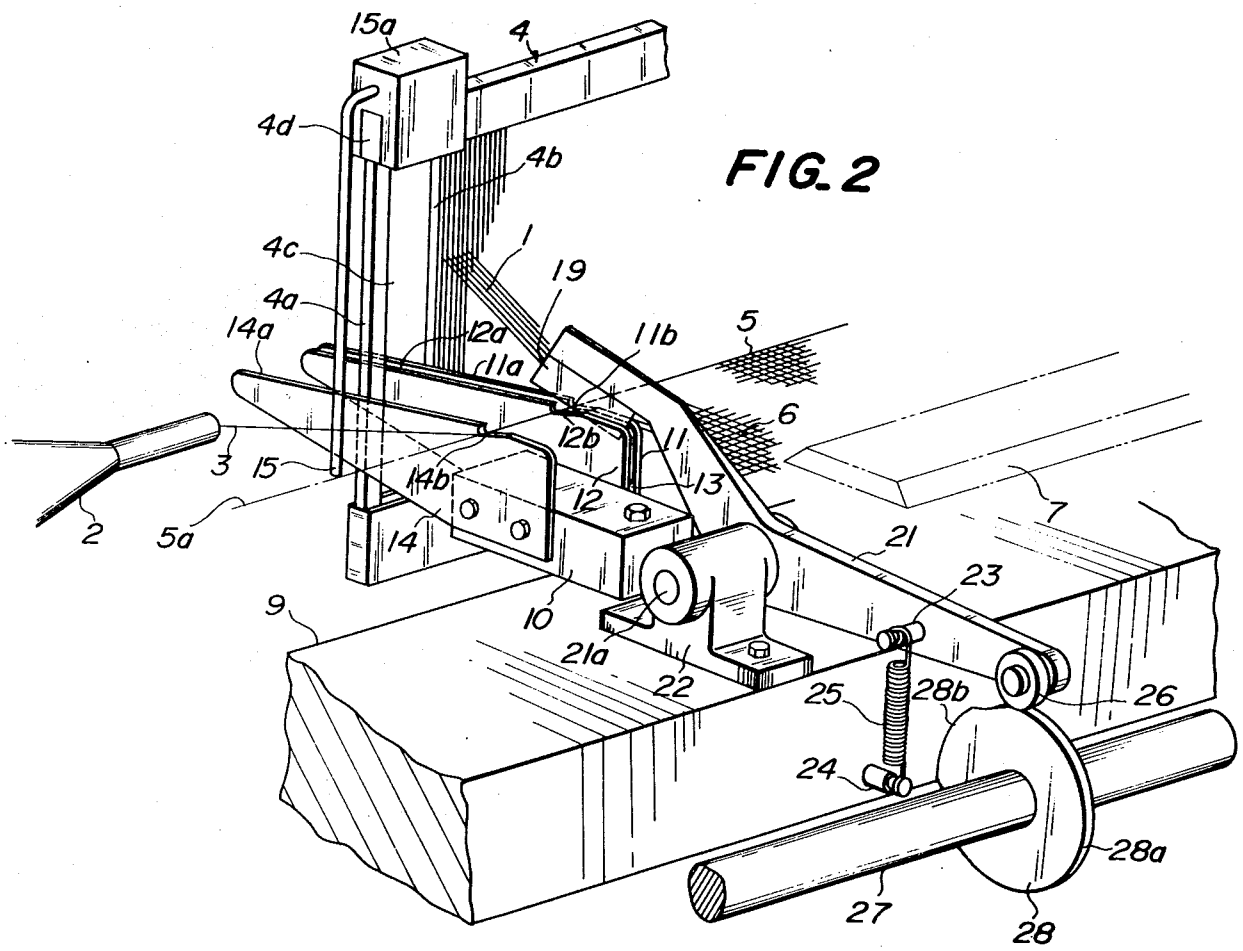
FIG. 2 is a perspective view of a cutting device according to a second embodiment of the present invention.

FIG. 2 shows a second embodiment of the present invention which differs to the arrangement shown in FIG. 1 in the following points.

In this embodiment, a cutting plate 19 is fixedly connected to one end of a lever 21 which is provided on its middle portion a shaft 21*a* rotatably journaled by a bearing 22. The lever 21 is biased by a spring 25 clockwisely in the figure, which is arranged between a pin 23 secured to the lever 21 and a pin 24 secured to the frame 8, so that a cam follower 26 pivotally mounted on the other end of the lever 21 is urged against a cam 28 fixedly connected to the rotational shaft 27 of the loom.

The cam 28 is formed with a lower portion 28*a* and a higher portion 28*b* which contacts the cam follower 26 at a predetermined time point after completion of the beating. As the lower portion 28*a* of the cam 28 comes in abutting engagement with the cam follower 26, the lever 21 after a clockwise rotation is brought to a position where the lower edge of the cutting plate 19 is positioned above the recesses 11*b*, 12*b* of the weft guide members 11, 12, while as the higher portion 28*b* of the cam 28 comes in abutting engagement with the cam follower 26, the lever 21 is caused to rotate counterclockwisely so that the cutting plate 19 is inserted between the weft guide members 11, 12. Accordingly, the cutting plate 20 is adapted to vertically reciprocate between the guide members 11, 12.

According to this embodiment, after the weft 3 is engaged, as a result of the beating, into the recesses 11*b*, 12*b*, 14*b* of the guide members 11, 12, 14 and held on the extension line 5*a* of the cloth fell 5, the cam 28 at its higher portion 28*b* abuts the cam follower 26 to cause a counter-clockwise rotation of the lever 21. Consequently, the cutting plate 19 is inserted between the pair of the guide members 11, 12 and cuts at its lower edge the weft 3 held by the recesses 11*b*, 12*b*.

In this embodiment, the cutting plate 19 may be disposed on the side which is opposite to the picking side. With this arrangement, in order that the cutting plate 19 cuts the wefts 3 at the location obtained after two to three picking operations, the cutting plate 19 is so arranged that the rear edge thereof reciprocates about that location of the weft. In this instance, since the weft is caught by the arresting yarn and is sufficiently tensioned thereby, the recesses 11*b*, 12*b* may be dispensed with.

Figure 3:
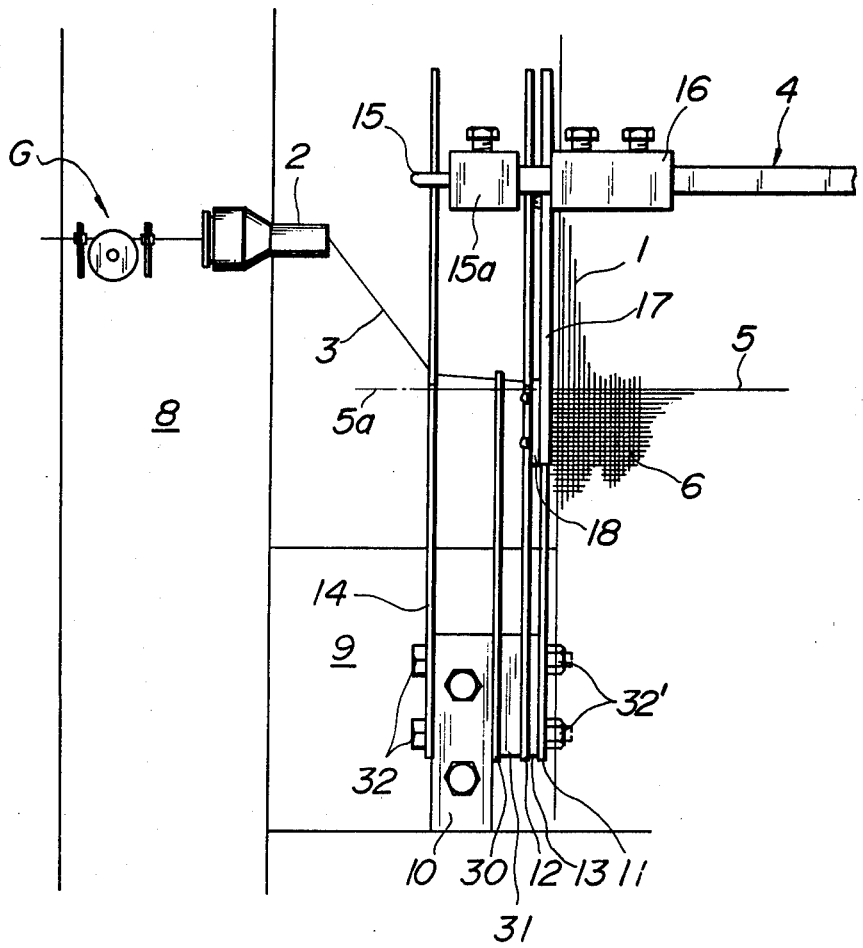
FIG. 3 is a plan view of a cutting device according to a third embodiment of the present invention.
Figure 4:
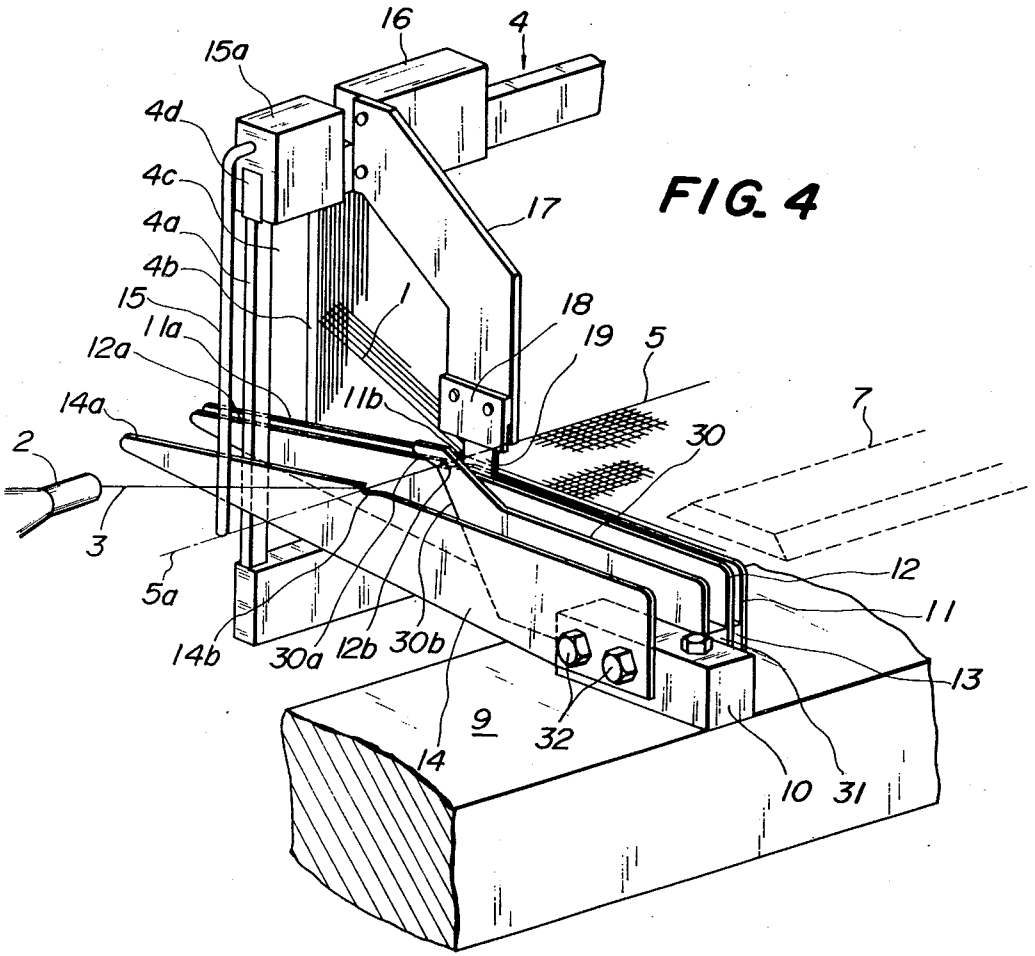
FIG. 4 is a perspective view of the cutting device shown in FIG. 3.
Figure 5:
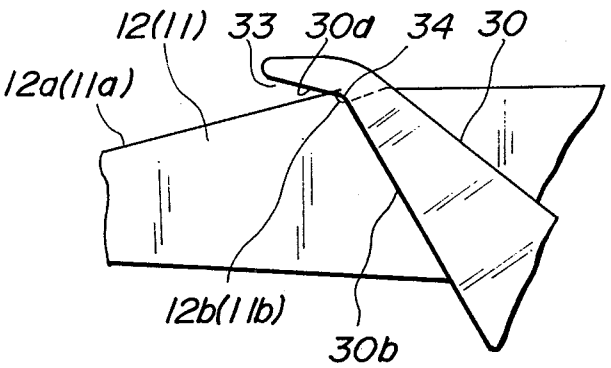
FIG. 5 is a fragmentary side view of the cutting device shown in FIG. 3.

FIGS. 3, 4 and 5 show a third embodiment of the present invention. In this embodiment, the gripper is shown at G. Adding to the arrangement shown in FIG. 1, there is further provided a plate-like member 30 for preventing escapement of the weft. This escapement-preventing member 30 is arranged between the bracket 10 and the weft guide members 11, 12; a spacer 31 being disposed to corporate with the bracket 10 so as to clamp the escapement prevention member 30 therebetween. Suitable fastening means, such as bolts 32 and nuts 32', serve to fixedly secure to the bracket 10 the guide members 11, 12, 14 and the escapement prevention member 30.

The escapement preventing member 30 has at its free end an upwardly inclined lower edge. In other words, the members 30 is formed with an edge 30*b* which steeply rises toward the extension line 5*a* of the cloth fell 5, and an edge 30*a* which is contiguous with the edge 30*b* and rises less steeply from the neighbourhood of the extension line 5*a* to the free end of the member 30. As shown in FIG. 5, seen from the side of the nozzle 2, the edge 30*a* together with the inclined guide portion 12*a* (11*a*) defines a wedge-shaped guide space 33, while the edge 30*b* together with the recess 12*b* (11*b*) defines a holding space 34 which is closed as viewed sidewisely.

At the location corresponding to the escapement preventing member 30, the reed 4 is not provided with blades 4*b* so as to allow movement of the member 30 with respect to the reed 4.

As the weft is engaged into the recesses 11*b*, 12*b*, 14*b* of the guide members 11, 12, 14, the weft is also guided by the edge 30*a* of the escapement preventing member 30 and reaches the edge 30*b* where it is introduced into the holding space 34. At the time of beating, the length of the weft path between the gripper G and the weaving edge tends to be elongated. But, as the gripping force of the gripper G is reduced, full length of the weft is drawn out of its supply means so that the weft is not sufficiently tensioned even when held by the recesses 11*b*, 12*b*, 14*b*. Occasionally, due to mechanical vibration of the guide members 11, 12, 14, the weft may move upwardly to escape from the recesses. However, according to the present embodiment, such an escapement can be prevented since under such a condition the weft abuts the lower edge 30*b* of the escapement preventing member 30. By means of the cutting plate 19, cutting of the weft is effected in the manner described with reference to FIG. 1.

In this embodiment, the escapement preventing member 30 may be disposed on the side of the guide member 11 facing to the cloth 6. However, since the pair of the guide members 11, 12 have to be disposed as close to the cloth 6 as possible, in order to shorten the length of selvage, the escapement preventing member 30 may advantageously be disposed on the side of the guide member 12 which is remote from the cloth.

Figure 6:
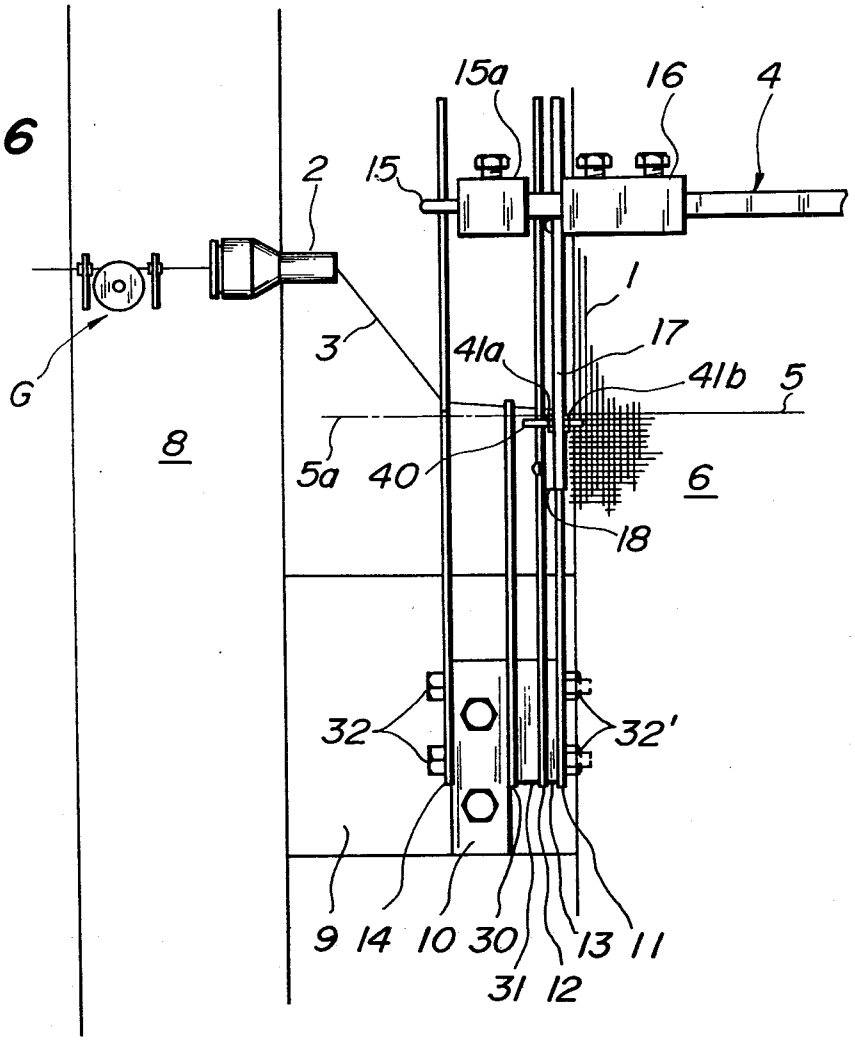
FIG. 6 is a plan view of a cutting device according to a fourth embodiment of the present invention.
Figure 7:
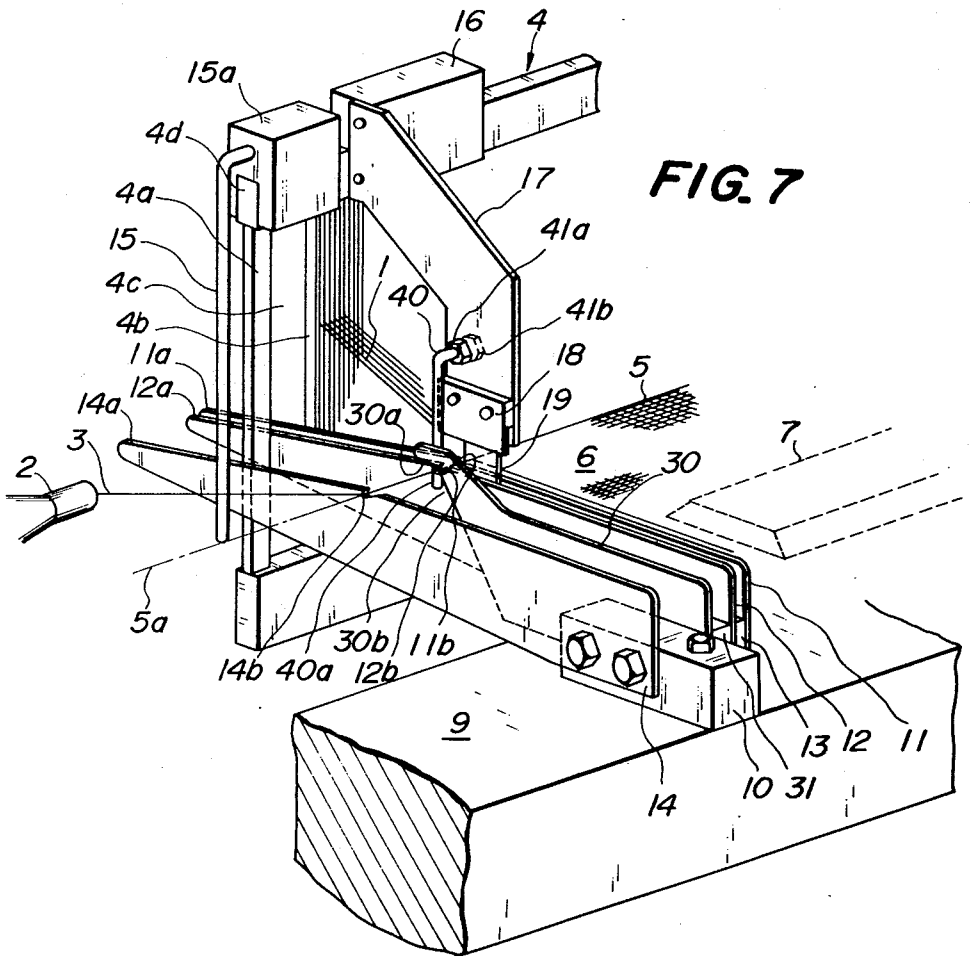
FIG. 7 is a perspective view of the cutting device shown in FIG. 6.
Figure 8:
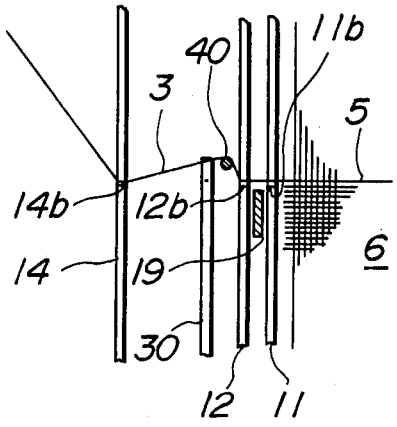
FIG. 8 is a fragmentary plan view of the cutting device shown in FIG. 6.

FIGS. 6, 7 and 8 show a fourth embodiment of the present invention. In addition to the arrangement shown in FIGS. 3, 4 and 5, according to the present embodiment, there is further provided a tensioning rod 40 having a threaded end extending through the middle part of the arm 17. The tensioning rod 40 is fixed by a pair of nuts 41*a*, 41*b* which engage the threaded end of the rod 40 and clamp the arm 17 therebetween. The tensioning rod 40 extends downwardly, and is provided with a free end 40*a* which is so positioned between the weft guide member 12 and the escapement preventing member 30 that, as the reed 4 is retracted, the free end 40*a* moves across the extension line 5*a* of the clutch fell 5 before the cutting plate 19 reaches this line 5*a*.

As in the embodiment of FIGS. 3 to 5, the weft 3 is held by the recesses 11*b*, 12*b*, 14*b* of the guide member 11, 12, 14, while escapement of the weft from the recesses 11*b*, 12*b*, 14*b* is prevented by the member 30. According to the present embodiment, as the reed 4 is retracted after completion of the beating, the tensioning rod 40 moves between the weft guide 12 and the escapement preventing member 30 and reaches the holding space 34. Here, as shown in FIG. 8, the tensioning rod 40 engages the weft 3 to form a bent projecting toward the reed 4 so as to tension the weft. Then, shortly after this tensioning, the cutting plate 19 engages at its lower edge with the weft 3 held by, and tensioned between the recesses 11*b*, 12*b* so as to effect cutting of the weft. By a suitable setting of the tension obtained by means of the tension rod 40, the weft 3 is kept to extend straightly between the recesses 11*b*, 12*b* just before being engaged and cut by the cutting plate 19, so that the length of the selvage can be reduced.

Since the tensioning rod 40 is connected, similarly to the cutting plate 19, to the arm 17 and driven by the reed 4, no separate drive means therefor is required. However, the rod 40 may be provided separately, without connecting to the arm 17, and driven synchronously with the above-mentioned timing sequence by means of a separate drive.

In all the embodiments thus far described, the cutting plate may consist of quenched steel or alumina porcelain. In this case, durability of the cutting plate can remarkably be improved.

What is claimed is:

1. A device for cuttings wefts in a shuttleless loom comprising a plurality of juxtaposed weft guide members disposed on a side of a woven cloth, the weft guide members engaging the weft during and after beating so as to guide the weft toward the cloth fell, and a plate-like cutting member adapted to move synchronously with the loom between a pair of the guide members, the cutting member after the beating being caused to move across the weft engaged by the guide members and a further weft guide member is provided on the outer side of the pair of the weft guide members between which the cutting member moves.

2. A device for cutting wefts in a shuttleless loom comprising a plurality of juxtaposed weft guide members disposed on a side of a woven cloth, the weft guide members engaging the weft during and after beating so as to guide the weft toward the cloth fell, each weft guide member being formed with a stepped portion shaped to hold the weft, an escapement preventing member disposed near the stepped portions of the weft guide members so as to prevent escapement of the weft from the stepped portions by which the weft is held, and a plate-like cutting member adapted to move synchronously with the loom between a pair of the guide members, the cutting member after the beating being caused to move across the weft held by the stepped portions of the weft guide members.

3. The device as defined in claim 2, wherein the escapement preventing member is disposed on the side of the cutting member which is remote from the cloth, the escapement preventing member being so arranged as to limit an upward movement of the weft held by the stepped portions of the weft guide members.

4. The device as defined in claim 2, wherein the cutting member is fixedly connected to a reed of the loom for effecting the beating to thereby provide a synchronous motion of the cutting member.

5. The device as defined in claim 2, wherein each weft guide member is provided with an inclined guide portion extending substantially at the same angle with lower warps forming a warp shed, the stepped portion being disposed at one end of the inclined portion.

6. The device as defined in claim 2, wherein a further weft guide member is provided on the outer side of the pair of the weft guide members between which the cutting member moves.

7. A device for cutting wefts in a shuttleless loom comprising a plurality of juxtaposed weft guide members disposed on a side of a woven cloth, the weft guide members engaging the weft during and after beating so as to guide the weft toward the cloth fell, each weft guide member being formed with a stepped portion shaped to hold the weft, an escapement preventing member disposed in the vicinity of the stepped portions of the weft guide members so as to prevent escapement of the weft from the stepped portions by which the weft is held, a plate-like cutting member adapted to move synchronously with the loom between a pair of the guide members, the cutting member after the beating being caused to move across the weft held by the stepped portions of the weft guide members, and a tensioning member disposed near the cutting member and so arranged as to move across the weft earlier than the cutting member.

8. The device as defined in claim 7, wherein the tensioning member is integrally connected to the cutting member.

9. The device as defined in claim 7, wherein the tensioning member is located on the side of the cutting member which is remote from the woven cloth.

* * * * *